US006290476B1

(12) United States Patent
Wu

(10) Patent No.: US 6,290,476 B1
(45) Date of Patent: Sep. 18, 2001

(54) HAND PUMP WITH AUTOMATIC AND MANUAL INFLATION FUNCTIONS

(76) Inventor: Scott Wu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/480,772

(22) Filed: Jan. 10, 2000

(51) Int. Cl.[7] ..... F04B 39/10
(52) U.S. Cl. ..... 417/549
(58) Field of Search ..... 417/549, 544, 417/506, 510, 238, 236, 546, 553; 222/5, 401, 402

(56) References Cited

U.S. PATENT DOCUMENTS 2,016,113 * 10/1935 Lambert et al. ..... 221/73.5
2,828,050 * 3/1958 Engelder ..... 222/5
2,970,399 * 2/1961 Frohlich ..... 43/6
3,596,799 * 8/1971 Fairchild ..... 222/5
3,597,780 * 8/1971 Coyle ..... 9/316
3,910,465 * 10/1975 Loeffler ..... 222/389
5,628,350 * 5/1997 Gibb ..... 141/38
6,065,947 * 5/2000 Wu ..... 417/526

* cited by examiner

*Primary Examiner*—Timothy S. Thorpe
*Assistant Examiner*—W. Rodriguez
(74) *Attorney, Agent, or Firm*—Alan D. Kamrath; Rider Bennett Egam & Arundel, LLP

(57) ABSTRACT

A hand pump includes an automatic inflation device and a manual inflation device. The automatic inflation device includes a gas container containing pressurized gas for providing automatic and rapid inflation. When the automatic inflation device malfunctions or the gas container runs out of gas, the manual inflation device can be manually operated for inflation.

15 Claims, 6 Drawing Sheets

HAND PUMP WITH AUTOMATIC AND MANUAL INFLATION FUNCTIONS

BACKGROUND OF THE INVENTION

1. Field of the Invention

The present invention relates to a hand pump with an automatic inflation valve and a manual inflation valve such that the user may choose the optional one for inflation.

2. Description of the Related Art

A typical automatic inflation device includes a gas container containing high-pressure gas (usually carbon dioxide) therein to allow rapid inflation. The gas container can be used only once. Namely, the user must replace a new one when the original container is used (opened), yet the user often forgets to do so. The present invention is intended to provide a hand pump with both automatic and manual inflation functions that mitigates and/or obviates the above problems.

SUMMARY OF THE INVENTION

It is a primary object of the present invention to provide a hand pump with an automatic inflation valve and a manual inflation valve to provide convenient optional choice to the user. The manual inflation device allows the hand pump to perform manual inflation operation when the automatic inflation malfunctions or the user forgot to replace a new gas container after previous use.

A hand pump in accordance with the present invention comprises:

- a head including a compartment, a first passage communicated with the compartnent, and a second passage;
- a cylinder including an inner chamber for receiving a gas container therein;
- a first inflation valve mounted to the first passage;
- a second inflation valve mounted to the second passage;
- means for opening the gas container in the inner chamber;
- means for guiding gas from the gas container to the first passage; and
- a handle mounted around the cylinder to define an outer chamber between the handle and the cylinder, the handle being manually operable to slide relative to the cylinder, thereby forcing ambient air into the second passage via the outer chamber for inflation.

The inner chamber is communicated with the second passage and the outer chamber is communicated with the inner chamber via an air passage. The air passage includes a check-valve mounted therein such that air is only flowable from the outer chamber into the inner chamber. The cylinder includes a one-way valve means mounted in an outer periphery thereof such that air is only flowable from ambience into the outer chamber when the handle is moved away from the cylinder and that air is not flowable from ambience into the outer chamber when the handle is moved toward the cylinder. The cylinder includes an outer stop on the outer periphery thereof and the handle includes an inner stop on an inner periphery thereof to prevent disengagement of the handle from the cylinder.

The means for opening the gas container includes a needle securely mounted in the compartment and having a longitudinal hole. A plug is mounted around a portion of the needle and compressible to expose to the needle. The cylinder is movable toward to the head such that the gas container is moved to compress the plug and thus opened by the needle for supplying gas contained in the gas container.

The cylinder and the head may be in threading connection to allow relative sliding movement therebetween upon rotation of one of the cylinder and the head.

A flow control valve is mounted in the head for controlling flow rate of gas from the gas container to the first passage. In a preferred embodiment of the invention, the flow control valve includes:

- a control member in threading connection with the compartment of the head, the control member including a first end in the compartment of the head and a second end beyond the head for manual operation;
- a valve stem slidably mounted in the compartment of the head, the valve stem including a first side and a second side;
- an O-ring attached to the first side of the valve stem;
- an elastic member having a first end attached to the second side of the valve stem and a second end attached to the needle, the elastic member biasing the O-ring toward the shoulder of the compartment for blocking the compartment;
- whereby the control member is moved longitudinally relative to the valve stem upon rotation of the control member, the valve stem is movable by the control member away from the shoulder to open the compartment, thereby controlling flow rate of gas from the gas container to the first passage.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
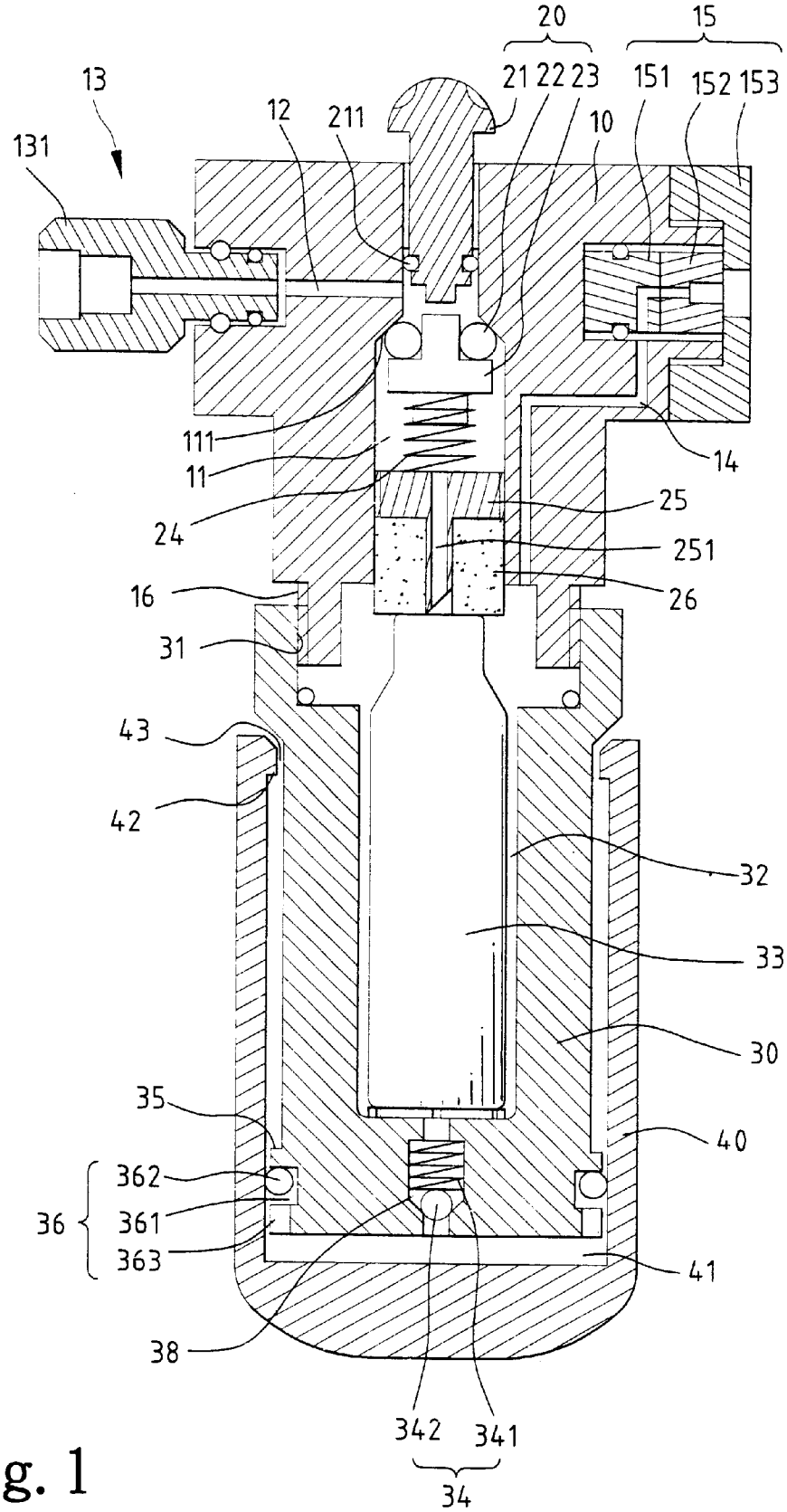
FIG. 1 is a sectional view of a hand pump in accordance with the present invention.

Referring to FIG. 1, a hand pump in accordance with the present invention generally includes a head 10 having a compartment 11, the compartment 11 having a shoulder 111. The head 10 further includes a first passage 12 to which a first inflation valve 13 is mounted and a second passage 14 to which a second inflation valve 15 is mounted. Inlet of the first passage 12 is communicated with the compartment 11. The first inflation valve 13 is mounted to an outlet (not labeled) of the first passage 12 and includes a nozzle 131 for engaging with an object to be inflated, e.g., a tire valve of a bicycle. The second inflation valve 15 is mounted to an outlet (not labeled) of the second passage 14 and includes a nozzle 151, a nozzle plug 152, and an outer cap 153. Nevertheless, it is noted that other inflation valves can be used to replace the first and second inflation valves 13 and 15.

A needle 25 is securely mounted in the compartment and includes a longitudinal hole 251. A plug 26 is mounted around an end (or a portion) of the needle 25 and is made of compressible material such that the plug 26 may be compressed along a longitudinal direction to expose the needle 25 for opening a gas container 33. A low control valve 20 is mounted in the head 10. In this embodiment, the flow control valve 20 includes a control member 21 that is in threading connection with the compartment 11 and that has a first end mounted in the compartment 11 and a second end beyond the head 10 for manual operation. An O-ring 211 is mounted around the first end of the control member 21 to prevent leakage of gas. The flow control valve 20 further includes a valve stem 23, an O-ring 22 attached to a side of the valve stem 23, and an elastic member 24 having a first end attached to the other side of the valve stem 23 and a second end attached to the needle 25. Thus, the valve stem 23 may be actuated by the control member 21 to move toward/away from the first compartment 12 to thereby control flow rate of the gas from the gas container 22, which will be described later.

A cylinder 30 includes an end with inner threading 31 for engaging with outer threading 16 of the head 10 such that the cylinder 30 may be moved toward or away from the head 10 upon rotation of the cylinder 30. The cylinder 30 includes an inner chamber 32 for receiving the gas container 33. The gas container 33 contains pressurized gas (usually carbon dioxide) for supplying air into the first inflation valve 13 via the needle 25, which will be described later.

A substantially U-shape handle 40 is mounted around the cylinder 30, thereby defining an outer chamber 41 between the handle 40 and the cylinder 30. The handle 40 is slidable relative to the cylinder 30. An air passage 38 is defined in the cylinder 30 and intercommunicates the inner chamber 32 with the outer chamber 41. A check valve 34 (including a ball 342 and a spring 341) is mounted in the air passage 38 such that air is only flowable from the outer chamber 41 into the inner chamber 32 via the air passage 38. The handle 40 includes an inner stop 42 (e.g., an inner flange) on an inner periphery thereof and the cylinder 30 includes an outer stop 35 (e.g., an outer flange) on an outer periphery thereof to prevent disengagement of the handle 40 from the cylinder 30. Below the outer stop 35, a one-way valve means 36 is mounted in the outer periphery of the cylinder 30. In this embodiment, the one-way valve means 36 is an annular groove 361 with a notch 363 defined in an end thereof. An O-ring 362 is mounted in the annular groove 361, which will be described later.

Figure 2:
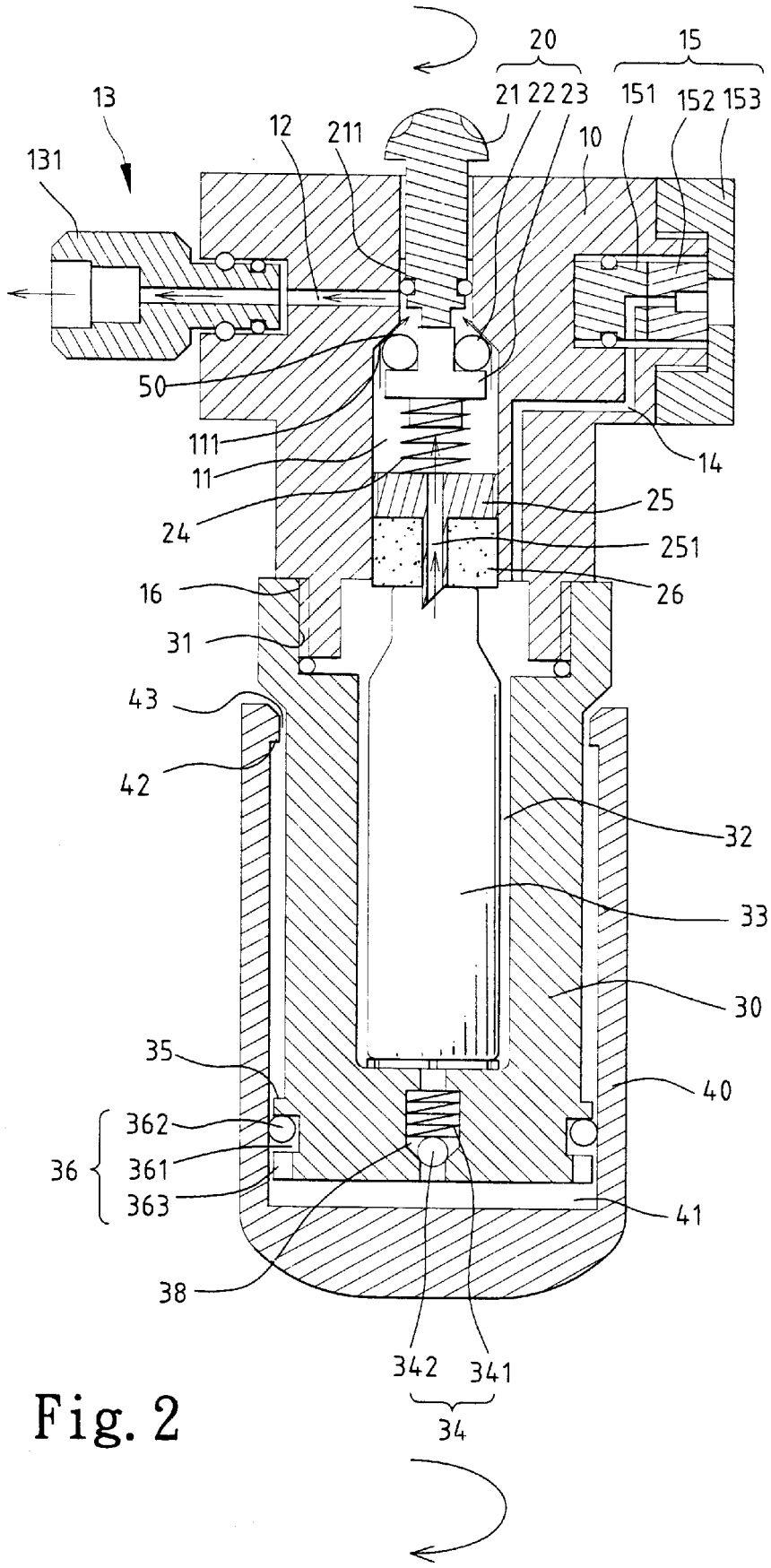
FIG. 2 is a sectional view similar to FIG. 1, wherein the gas container outputs gas in a lower flow rate.
Figure 3:
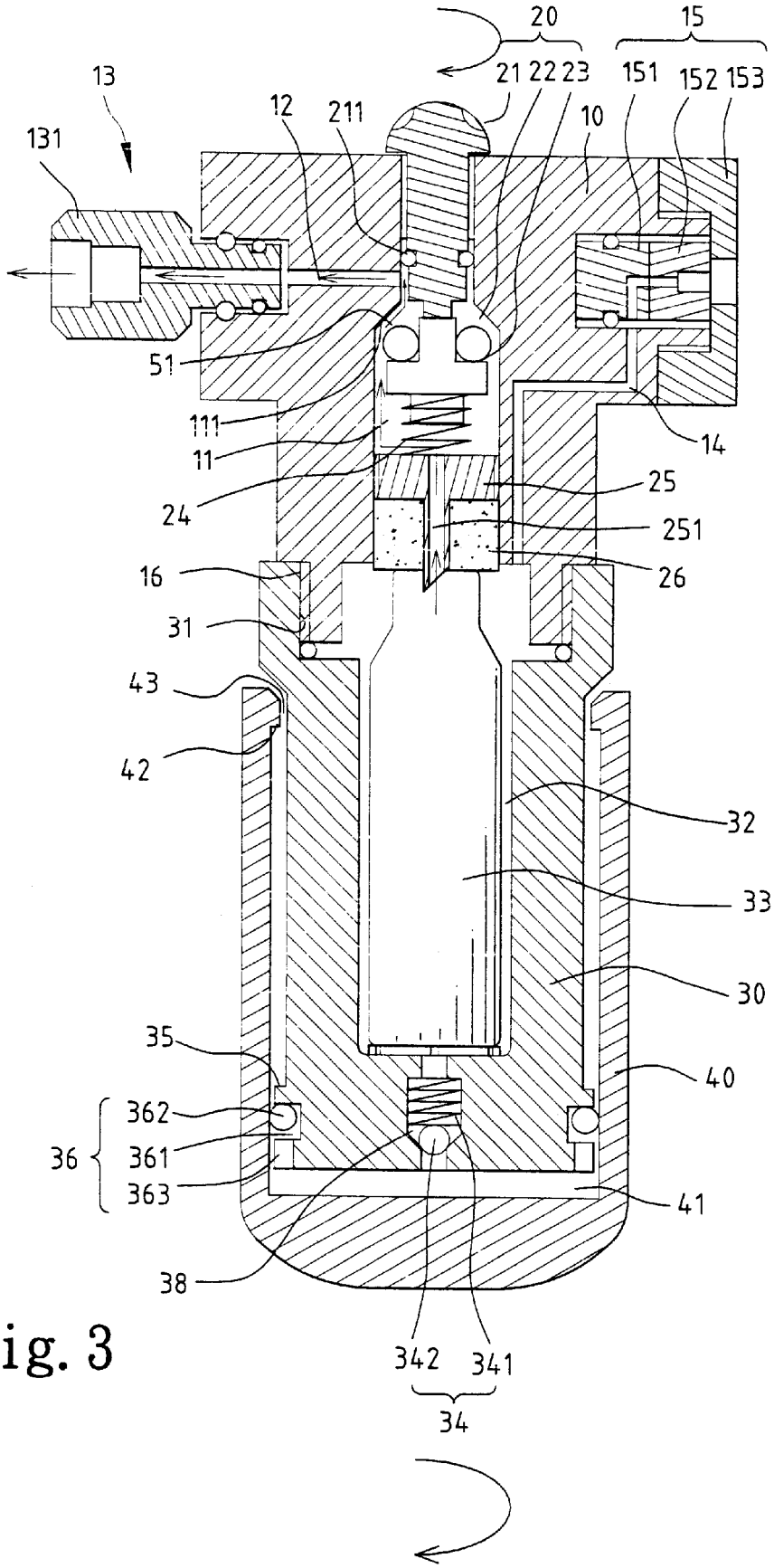
FIG. 3 is a sectional view similar to FIG. 2, wherein the gas container outputs gas in a higher flow rate.

The gas container 33 in FIG. 1 is in a sealed condition and the valve stem 23 of the flow control valve 20 is biased by the elastic member 24 toward the control member 21 such that the O-ring 22 bears against the shoulder 111 of the compartment 11, thereby blocking the compartment 11. When automatic inflation is required, the user may rotate the cylinder 30 to make the cylinder 30 move toward the head 10 due to threading connection therebetween. As a result, the gas container 33 is moved to compress the plug 26 and thus in contact with the needle 25, as shown in FIG. 2. In addition, the control member 21 of the flow control valve 20 is rotated to move toward the valve stem 23 to thereby make the compartment 11 communicate with the first passage 12. Thus, the gas container 33 is opened by the needle 25 and the gas (carbon dioxide) in the gas container 33 is supplied to the inflation valve 13 via the longitudinal hole 251 of the needle 25, the compartment 11, and the first passage 12. It is noted that the gas container 33 in FIG. 2 outputs gas in a lower flow rate. When a higher flow rate is required, the user may further rotate the control member 21 to move the valve stem 23 more downward, best shown in FIG. 3.

Figure 4:
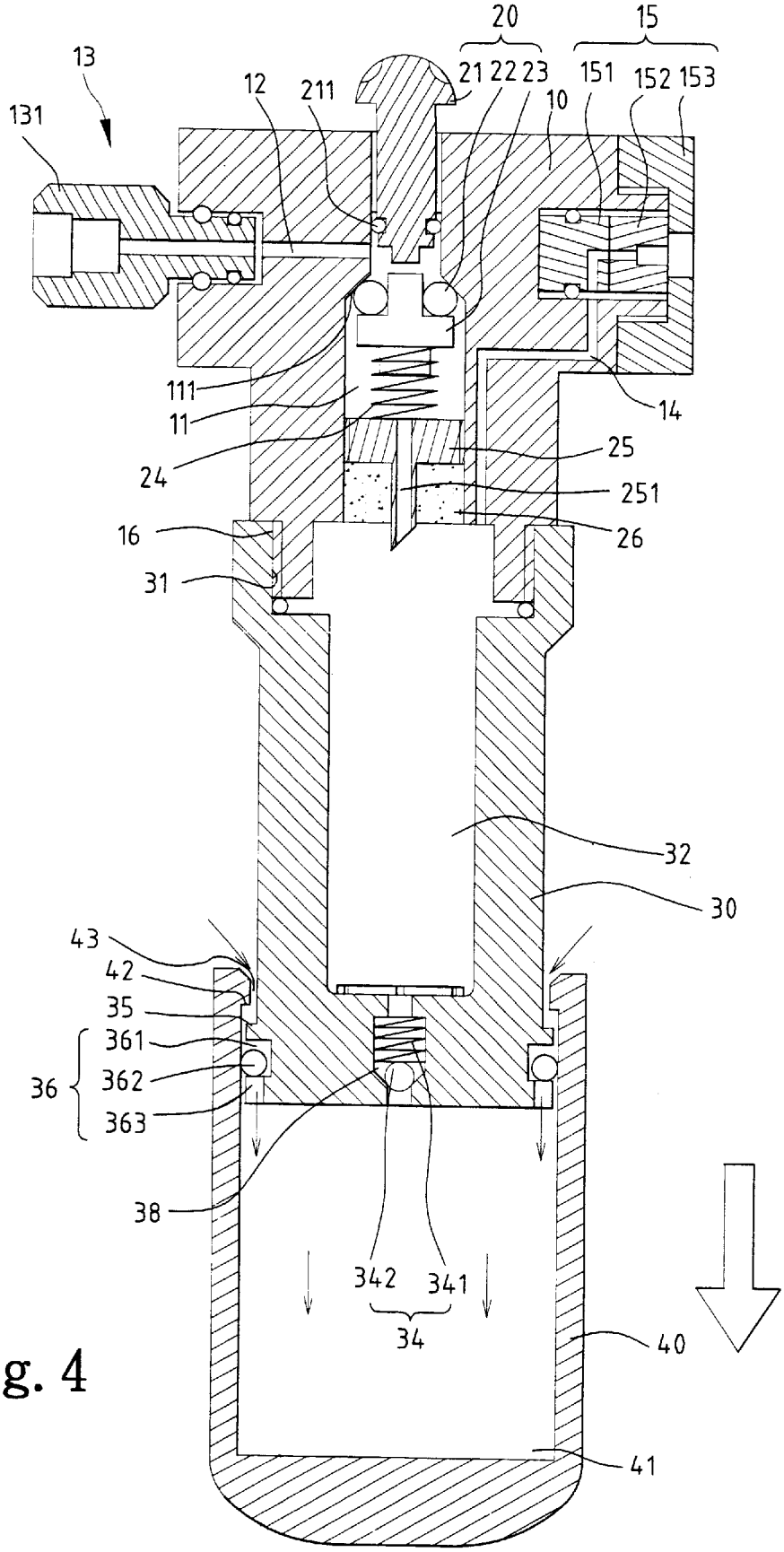
FIG. 4 is a sectional view similar to FIG. 1, wherein a handle of the hand pump is in its intake stroke.
Figure 5:
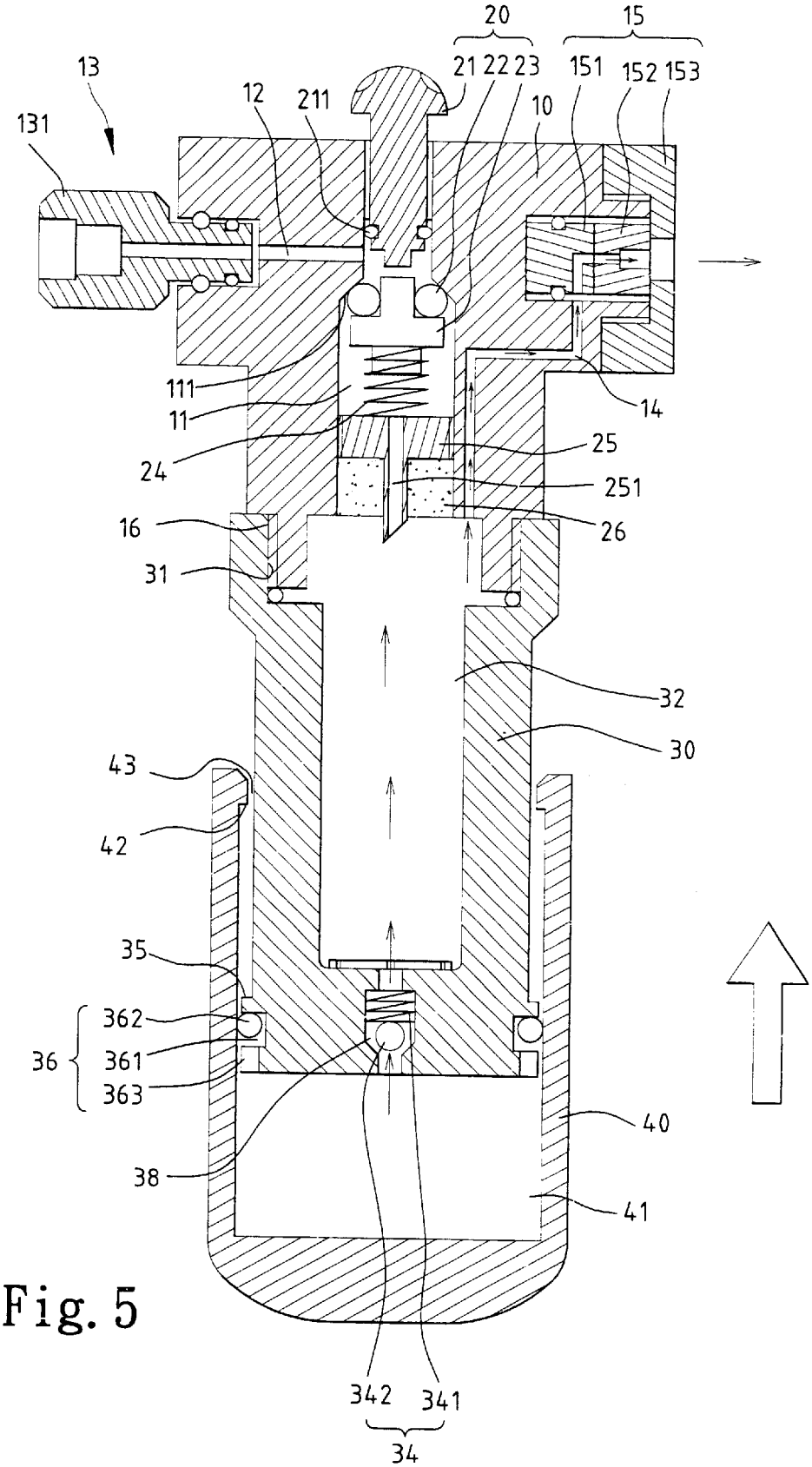
FIG. 5 is a sectional view similar to FIG. 4, wherein the handle is in an outtake stroke.

Referring to FIG. 4, when manual operation is required, e.g., the automatic inflation malfunctions or the gas container 33 runs out of gas, the gas container 33 is removed for manual inflation. As illustrated in FIG. 4, when the handle 40 is moved away from the cylinder 30, ambient air enters the outer chamber 41 via the one-way valve 36, as the O-ring 362 is moved to the notch 363 of the annular groove 361 and thus allows air to pass through the notch 363. Referring to FIG. 5, when the handle 40 is moved toward the cylinder 30, air in the outer chamber 41 enters the inner chamber 32 via the check valve 34 and then exits the hand pump via the second passage 14 and the second inflation valve 15. Thus, manual inflation is allowed. It is noted that the gas container 33 may have a distance to an inner periphery defining the inner chamber 32 such that manual inflation still can be proceeded without removing the gas container 33. In addition, the air passage 38 in the cylinder 38 may be arranged in a way other than the embodiment shown in FIGS. 1 through 5.

Figure 6:
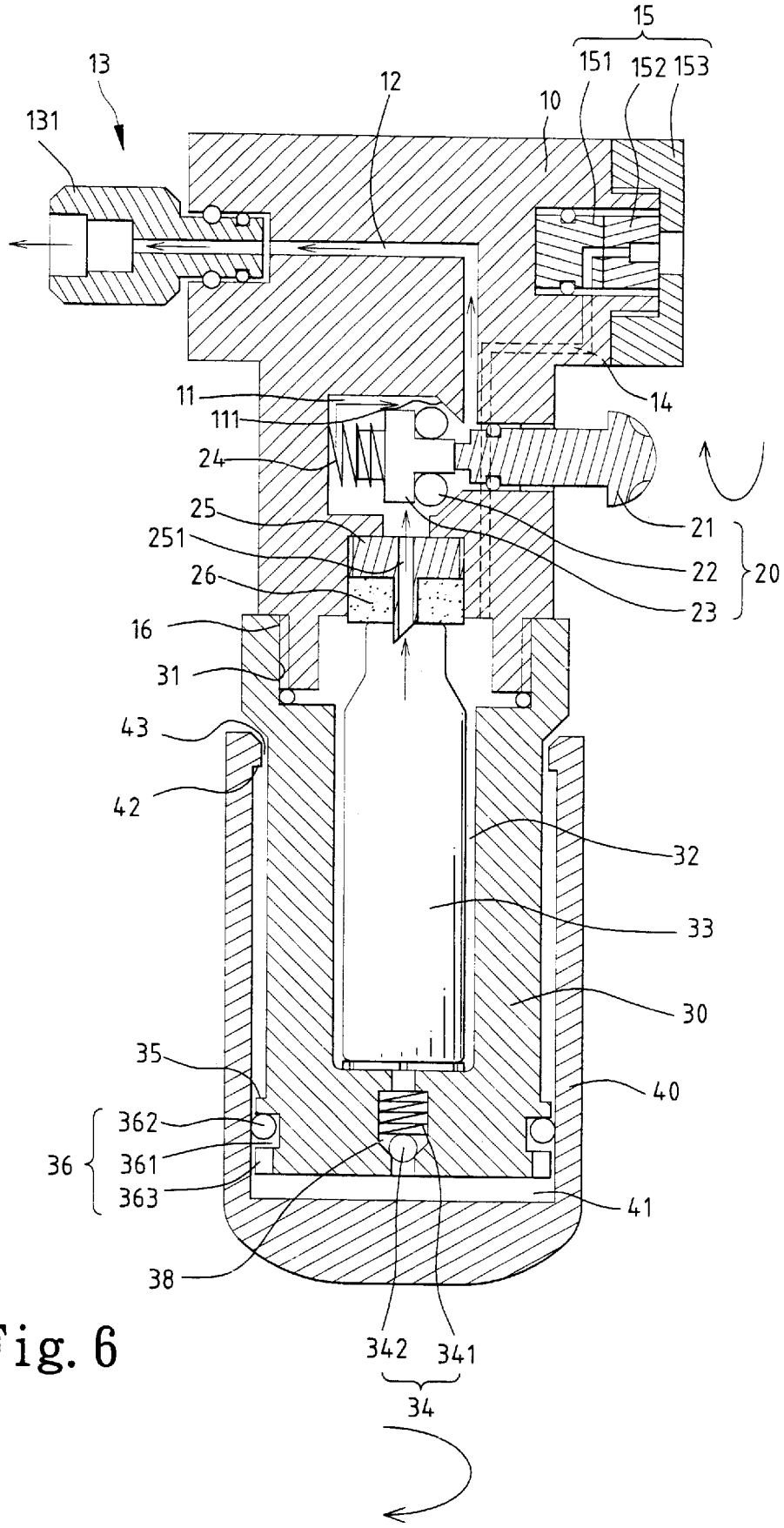
FIG. 6 is a view similar to FIG. 1, illustrating a modified embodiment of the hand pump in accordance with the present invention.

FIG. 6 illustrates a modified embodiment of the hand pump in accordance with the present invention, wherein the flow control valve 20 is arrange in a different orientation without affecting its function.

According to the above description, it is appreciated that the hand pump of the invention may automatically or manually inflate the valve of the object to be inflated. Thus, the hand pump can be used even if the user forgot to replace a new gas container after previous use.

Although the invention has been explained in relation to its preferred embodiment, it is to be understood that many other possible modifications and variations can be made without departing from the spirit and scope of the invention as hereinafter claimed.

What is claimed is:

1. A hand pump comprising:

a head including a compartment, a first passage communicated with the compartment, and a second passage;

a cylinder including an inner chamber for receiving a gas container therein;

a first inflation valve mounted to the first passage;

a second inflation valve mounted to the second passage;

means for opening the gas container in the inner chamber;

means for guiding gas from the gas container to the first passage; and a handle mounted around the cylinder to define an outer chamber between the handle and the cylinder, the handle being manually operable to slide relative to the cylinder, thereby forcing ambient air into the second passage via the outer chamber for inflation.

2. The hand pump as claimed in claim 1, wherein the inner chamber is communicated with the second passage and wherein the outer chamber is communicated with the inner chamber via an air passage.

3. The hand pump as claimed in claim 2, wherein the air passage includes a check-valve mounted therein such that air is only flowable from the outer chamber into the inner chamber.

4. The hand pump as claimed in claim 3, wherein the cylinder includes a one way valve mounted in an outer periphery thereof such that air is only flowable from ambience into the outer chamber when the handle is moved away from the cylinder and that air is not flowable from ambience into the outer chamber when the handle is moved toward the cylinder.

5. The hand pump as claimed in claim 1, wherein the cylinder includes an outer stop on an outer periphery thereof and the handle includes an inner stop on an inner periphery thereof to prevent disengagement of the handle from the cylinder.

6. The hand pump as claimed in claim 4, wherein the cylinder includes an outer stop on the outer periphery thereof and the handle includes an inner stop on an inner periphery thereof to prevent disengagement of the handle from the cylinder.

7. The hand pump as claimed in claim 1, wherein the means for opening the gas container includes a needle securely mounted in the compartment and having a longitudinal hole, a plug being mounted around a portion of the needle and compressible to expose to the needle, whereby the cylinder is movable toward to the head such that the gas container is moved to compress the plug and thus opened by the needle for supplying gas contained in the gas container.

8. The hand pump as claimed in claim 7, wherein the cylinder and the head are in threading connection to allow relative sliding movement therebetween upon rotation of one of the cylinder and the head.

9. The hand pump as claimed in claim 1, further comprising a flow control valve mounted in the head for controlling flow rate of gas from the gas container to the first passage.

10. The hand pump as claimed in claim 7, further comprising a flow control valve mounted in the head for controlling flow rate of gas from the gas container to the first passage.

11. The hand pump as claimed in claim 10, wherein the compartment includes a shoulder and wherein the flow control valve includes:

a control member in threading connection with the compartment of the head, the control member including a first end in the compartment of the head and a second end beyond the head for manual operation;

a valve stem slidably mounted in the compartment of the head, the valve stem including a first side and a second side;

an O-ring attached to the first side of the valve stem;

an elastic member having a first end attached to the second side of the valve stem and a second end attached to the needle, the elastic member biasing the O-ring toward the shoulder of the compartment for blocking the compartment;

whereby the control member is moved longitudinally relative to the valve stem upon rotation of the control member, the valve stem is movable by the control member away from the shoulder to open the compartment, thereby controlling flow rate of gas from the gas container to the first passage.

12. The hand pump as claimed in claim 11, wherein the inner chamber is communicated with the second passage and wherein the outer chamber is communicated with the inner chamber via an air passage.

13. The hand pump as claimed in claim 12, wherein the air passage includes a check-valve mounted therein such that air is only flowable from the outer chamber into the inner chamber.

14. The hand pump as claimed in claim 13, wherein the cylinder includes a one-way valve means mounted in an outer periphery thereof such that air is only flowable from ambience into the outer chamber when the handle is moved away from the cylinder and that air is not flowable from ambience into the outer chamber when the handle is moved toward the cylinder.

15. The hand pump as claimed in claim 14, wherein the cylinder includes an outer stop on an outer periphery thereof and the handle includes an inner stop on an inner periphery thereof to prevent disengagement of the handle from the cylinder.

* * * * *